US010702902B2

(12) United States Patent
Iguchi et al.

(10) Patent No.: US 10,702,902 B2
(45) Date of Patent: Jul. 7, 2020

(54) METHOD OF MANUFACTURING FLARING-PROCESSED METAL PIPE

(71) Applicant: NIPPON STEEL & SUMITOMO METAL CORPORATION, Tokyo (JP)

(72) Inventors: Keinosuke Iguchi, Tokyo (JP); Shohei Tamura, Kimitsu (JP); Masaaki Mizumura, Kisarazu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 328 days.

(21) Appl. No.: 15/534,618

(22) PCT Filed: Dec. 25, 2015

(86) PCT No.: PCT/JP2015/086239
§ 371 (c)(1),
(2) Date: Jun. 9, 2017

(87) PCT Pub. No.: WO2016/104706
PCT Pub. Date: Jun. 30, 2016

(65) Prior Publication Data

US 2017/0320116 A1 Nov. 9, 2017

(30) Foreign Application Priority Data

Dec. 26, 2014 (JP) ..... 2014-264337

(51) Int. Cl.
*B21C 37/15* (2006.01)
*B21C 37/16* (2006.01)
*B21D 41/02* (2006.01)

(52) U.S. Cl.
CPC ..... *B21C 37/15* (2013.01); *B21C 37/16* (2013.01); *B21D 41/02* (2013.01); *B21D 41/026* (2013.01)

(58) Field of Classification Search
CPC ..... B21D 41/00; B21D 41/02; B21D 41/021; B21D 41/025; B21D 41/026;
(Continued)

(56) References Cited

U.S. PATENT DOCUMENTS 6,260,401 B1 * 7/2001 Tada ..... B21C 37/16 72/318
6,581,433 B2 * 6/2003 Otsuka ..... B21C 37/16 72/370.06

(Continued)

FOREIGN PATENT DOCUMENTS

CN 1219606 C 9/2005
JP 3027581 B1 4/2000

(Continued)

OTHER PUBLICATIONS

International Search Report for PCT/JP2015/086239 dated Feb. 9, 2016.

(Continued)

*Primary Examiner* — Adam J Eiseman
*Assistant Examiner* — Matthew Kresse
(74) *Attorney, Agent, or Firm* — Birch, Stewart, Kolasch & Birch, LLP

(57) ABSTRACT

A method of manufacturing a flaring-processed metal pipe from a hollow shell including a plurality of portions having different deformation resistances in a circumferential direction is provided, the method includes: among the plurality of portions, specifying a portion having a relatively small deformation resistance as a low deformation resistance section, and a portion having a relatively large deformation resistance as a high deformation resistance section; and press-fitting a pipe expansion punch into the hollow shell such that a thickness reduction rate of the low deformation (Continued)

resistance section is smaller than a thickness reduction rate of the high deformation resistance section.

16 Claims, 10 Drawing Sheets

(58) Field of Classification Search
CPC ..... B21D 41/028; B21D 41/04; B21D 39/08; B21D 51/00; B21D 51/16; B21D 19/08; B21D 19/082; B21D 3/00; B21D 3/005; B21D 39/203
See application file for complete search history.

(56) References Cited

U.S. PATENT DOCUMENTS

| | | | | |
|---|---|---|---|---|
| 7,225,868 | B2 * | 6/2007 | Arai | B21C 1/24 166/277 |
| 2009/0139295 | A1 * | 6/2009 | Motoo | B21D 39/20 72/370.06 |

FOREIGN PATENT DOCUMENTS

| | | | | |
|---|---|---|---|---|
| JP | 2002-346664 | | 12/2002 | |
| JP | 2003-126930 | A | 5/2003 | |
| JP | 2006-272350 | * | 10/2006 | B21D 41/02 |
| JP | 2006-272350 | A | 10/2006 | |
| JP | 2009-50888 | A | 3/2009 | |
| JP | 2009-136897 | A | 6/2009 | |
| JP | 4798875 | B2 | 10/2011 | |
| JP | 5221910 | B2 | 6/2013 | |

OTHER PUBLICATIONS

Written Opinion of the International Searching Authority for PCT/JP2015/086239 (PCT/ISA/237) dated Feb. 9, 2016.
Chinese Office Action dated May 3, 2018, issued in Chinese Counterpart application No. 201580070248.8.

* cited by examiner

METHOD OF MANUFACTURING FLARING-PROCESSED METAL PIPE

TECHNICAL FIELD OF THE INVENTION

The present invention relates to a method of manufacturing a flaring-processed metal pipe.

Priority is claimed on Japanese Patent Application No. 2014-264337, filed on Dec. 26, 2014, the content of which is incorporated herein by reference.

RELATED ART

As a method of manufacturing a flaring-processed metal pipe, a method of press-fitting a tapered pipe expansion punch (punch) from an open end of a metal pipe (raw pipe) which is a material and expanding the metal pipe in the radial direction thereof to form a pipe expanded section in the metal pipe is known (for example, refer to Patent Documents 1 and 2).

However, in the above-described manufacturing method, due to various factors, forming defects such as cracks in the pipe expanded section or buckling at the root of the pipe expanded section occur. Accordingly, it is required to prevent the occurrence of the above-described forming defects when the flaring-processed metal pipe is manufactured (the metal pipe is expanded and formed) from a raw pipe.

PRIOR ART DOCUMENT

Patent Documents

[Patent Document 1] Japanese Patent No. 4798875
[Patent Document 2] Japanese Patent No. 5221910

DISCLOSURE OF THE INVENTION

Problems to be Solved by the Invention

The inventors focused on a thickness distribution and a hardness distribution in the circumferential direction of the raw pipe as a cause of forming defects in the pipe expansion forming (pipe expansion processing) of the metal pipe.

FIG. 10A is a cross-sectional view showing an example of a thickness distribution of an electric resistance welded steel pipe 301 used as a material for pipe expansion forming, and FIG. 10B is a cross-sectional view showing an example of a thickness distribution of a seamless steel pipe 302 used as a material for the pipe expansion forming. In addition, FIG. 11 is a graph showing the thickness distribution of the electric resistance welded steel pipe 301 in the circumferential direction. In FIG. 11, a horizontal axis indicates an angle from a seam, that is, an angle from a weld 305 formed on the electric resistance welded steel pipe 301.

As shown in FIGS. 10A and 11, in the electric resistance welded steel pipe 301, a thickness t1 of a portion where the angle from the weld 305 is approximately 60° and a thickness t2 of a portion where the angle is approximately 150° are smaller than the thicknesses t3 to t5 of the other portions, and a thickness deviation occurs. Moreover, the thicknesses t1 and t2 are approximately 98% to 99% of the average value of the thicknesses.

In addition, as shown in FIG. 10B, in the seamless steel pipe 302, a thickness deviation occurs in which the thickness t7<the thickness t8<the thickness t9 is satisfied.

FIG. 12 is a graph showing the hardness distribution (strength distribution) of the electric resistance welded steel pipe 301 in the circumferential direction. Moreover, in FIG. 12, a horizontal axis indicates the position in the circumferential direction with the position of the weld of the electric resistance welded steel pipe 301 as a reference. As shown in FIG. 12, in the electric resistance welded steel pipe 301, a HAZ softened region exists near the weld. This HAZ softened region has a relatively lower hardness than those of other regions and has a hardness of approximately 90% of the average hardness.

As described above, the electric resistance welded steel pipe 301 has a non-uniform thickness distribution and hardness distribution in the circumferential direction, and the seamless steel pipe 302 has a non-uniform thickness distribution in the circumferential direction. When the electric resistance welded steel pipe 301 (or the seamless steel pipe 302) having the non-uniform distribution is uniformly flared and formed (expanded and formed) in the circumferential direction, a force which expands the electric resistance welded steel pipe 301 (or the seamless steel pipe 302) uniformly acts in the circumferential direction. In addition, since a deformation resistance is small in a section having a thin thickness (thin section) and a section having a low hardness (low hardness section), the deformation concentrates in these sections. As a result, despite the fact that a pipe expansion rate is much lower than deforming capacity of the steel pipe, forming defects such as breakage easily occur since thickness reduction rates of these sections are larger than the thickness reduction rates of the other sections.

The present invention is made in consideration of the above-described circumstances, and an object thereof is to provide a method of manufacturing a flaring-processed metal pipe in which it is possible to prevent occurrence of forming defects such as breakage when the flaring-processed metal pipe is manufactured from a hollow shell including a portion having a relatively small deformation resistance.

Means for Solving the Problem

In order to solve the above problem, the present invention adopts the following.

(1) According to an aspect of the present invention, there is provided a method of manufacturing a flaring-processed metal pipe having a pipe expanded section from a hollow shell including a plurality of portions having different deformation resistances when viewed in a circumferential direction, the method including: among the plurality of portions, specifying a portion having a relatively small deformation resistance as a low deformation resistance section, and a portion having a relatively larger deformation resistance than that of the low deformation resistance section as a high deformation resistance section; and press-fitting a pipe expansion punch into the hollow shell and expanding the hollow shell, in the press-fitting and the expanding, a thickness reduction rate of the low deformation resistance section is smaller than a thickness reduction rate of the high deformation resistance section.

(2) In the aspect described in the above (1), it may be configured as follows: the pipe expansion punch includes a first abutment surface which abuts the low deformation resistance section of the hollow shell, and a second abutment surface which abuts the high deformation resistance section of the hollow shell, and an inclination angle of the first abutment surface with respect to the central axis of the pipe expansion punch is smaller than an inclination angle of the second abutment surface with respect to the central axis, and in the press-fitting and the expanding, the pipe expansion punch is press-fitted into the hollow shell while the first abutment surface of the pipe expansion punch abuts the low deformation resistance section of the hollow shell and the second abutment surface of the pipe expansion punch abuts the high deformation resistance section of the hollow shell.

(3) In the aspect described in the above (2), the inclination angle of the first abutment surface of the pipe expansion punch may be 0°.

(4) In the aspect described in the above (2) or (3), it may be configured as follows: the press-fitting and the expanding include press-fitting the pipe expansion punch into the hollow shell to obtain an intermediate formed product from the hollow shell, and press-fitting a forming punch having a shape which coincides with an inner surface of the pipe expanded section of the flaring-processed metal pipe into the intermediate formed product.

(5) In the aspect described in the above (4), in the press-fitting of the pipe expansion punch, the pipe expansion punch may be press-fitted into the hollow shell such that a diameter expansion amount of the low deformation resistance section of the hollow shell is less than 0.5 times a diameter expansion amount of the high deformation resistance section of the hollow shell.

(6) In the aspect of any one of the above (1) to (5), the hollow shell may be an electric resistance welded steel pipe or a seamless steel pipe.

Effects of the Invention

According to each of the aspects of the present invention, it is possible to prevent occurrence of forming defects such as breakage when a flaring-processed metal pipe is manufactured from a hollow shell including a portion having a relatively small deformation resistance.

EMBODIMENT OF THE INVENTION

Figure 1A:
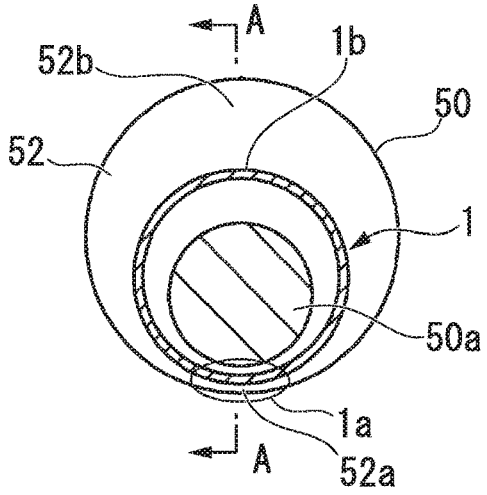
FIG. 1A is a front view showing a hollow shell and a pipe expansion punch used in a method of manufacturing a flaring-processed metal pipe according to a first embodiment of the present invention.

Hereinafter, embodiments of the present invention will be described in detail with reference to the drawings. In the present specification and the drawings, the same reference numerals are assigned to constituent elements having substantially the same functional configuration, and overlapping description thereof will be omitted.

First Embodiment

Figure 1B:
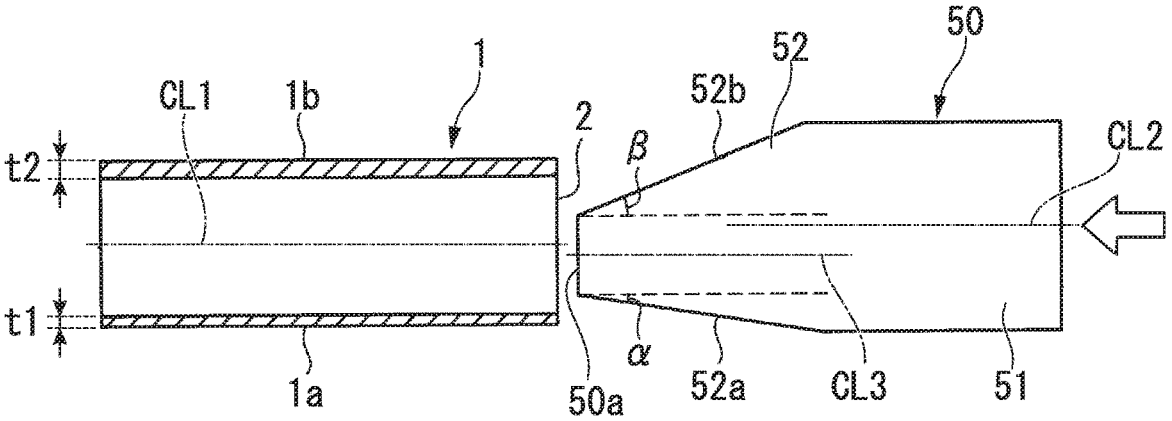
FIG. 1B is a sectional view taken along line A-A of the hollow shell and the pipe expansion punch shown in FIG. 1A.
Figure 3:
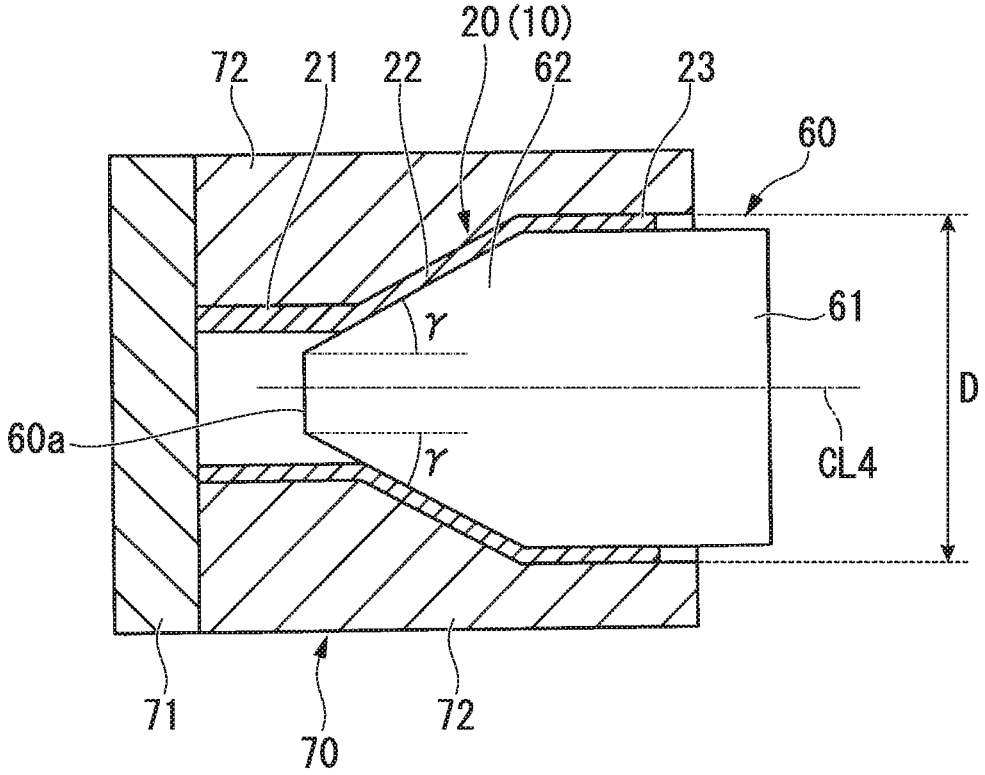
FIG. 3 is a sectional view showing a state in which a forming punch is press-fitted to an intermediate formed product obtained by expanding the hollow shell using the pipe expansion punch.

In a method of manufacturing a flaring-processed metal pipe according to the first embodiment of the present invention, a hollow shell 1 having a hollow circular cross section shown in FIGS. 1A and 1B is expanded and formed to manufacture a flaring-processed metal pipe 20 shown in FIG. 3. The flaring-processed metal pipe 20 is composed of a straight pipe section 21, a pipe expanded section 23 which is formed by expanding the end portion of the hollow shell 1, and a transition section 22 which is provided between the straight pipe section 21 and the pipe expanded section 23. In addition, for example, the flaring-processed metal pipe 20 is suitably used for automotive parts and the like.

For example, the material of the hollow shell 1 used for manufacturing the flaring-processed metal pipe 20 is a metal such as iron, aluminum, stainless steel, copper, titanium, magnesium, or steel. Preferably, a value n indicating a work hardening coefficient (distortion-effect index) of the hollow shell 1 is 0.01 to 0.3 from the viewpoint of preventing occurrence of buckling, and a pressing force required for pipe expansion forming from being excessive. Preferably, an r value indicating the deep drawability of the hollow shell 1 is 0.5 to 3 from the viewpoint of preventing occurrence of wrinkle, and the pressing force required for the pipe expansion forming from being excessive.

For example, the hollow shell 1 is an electric resistance welded pipe, a seamless pipe, a pipe manufactured by extrusion, a pipe manufactured by drawing, or the like.

FIGS. 1A and 1B are views showing the hollow shell 1 and a pipe expansion punch 50 used for expanding the hollow shell 1. In addition, FIG. 1A is a front view of the hollow shell 1 and the pipe expansion punch 50, and FIG. 1B is a sectional view taken along line A-A in FIG. 1A.

As shown in FIGS. 1A and 1B, the hollow shell 1 has a thickness t1 and a thickness t2 which is larger than the thickness t1 when viewed along the circumferential direction thereof. That is, the hollow shell 1 has a thin section 1*a* (low deformation resistance section) having the thickness t1 and a thick section 1*b* (high deformation resistance section) having a thickness t2.

For example, the thickness t1 of the thin section 1*a* is less than 99% of an average thickness of the hollow shell 1. Moreover, since the thin section 1*a* is thinner than the thick section 1*b*, the thin section 1*a* is more likely to be deformed than the thick section 1*b* when pipe expansion forming is performed. In other words, the thin section 1*a* has less deformation resistance against a force of expanding in the radial direction than the thick section 1*b*.

For example, the average thickness of the hollow shell 1 is 0.5 to 30 mm, and for example, the outer diameter of the hollow shell 1 is 15 to 700 mm. Preferably, the ratio of the average thickness of the hollow shell 1 to the outer diameter of the hollow shell 1 is 0.005 to 0.3. In this case, it is possible to efficiently manufacture the flaring-processed metal pipe 20 from the hollow shell 1.

For example, the thickness of the hollow shell 1 can be obtained using a measuring instrument such as a caliper. In addition, it is possible to specify the thin section 1*a* and the thick section 1*b* by ascertaining the thickness distribution of the hollow shell 1.

Figure 1C:
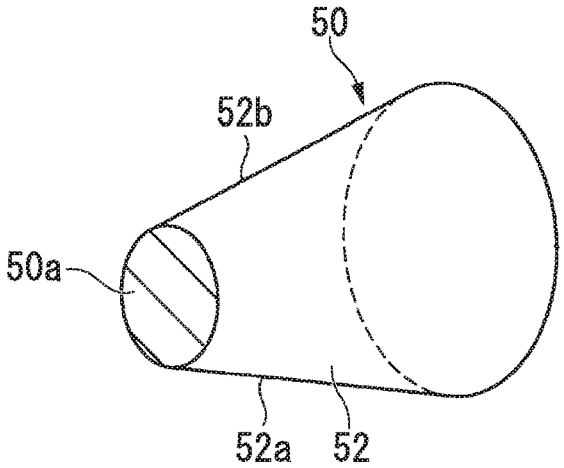
FIG. 1C is a schematic perspective view showing the pipe expansion punch.

As shown in FIGS. 1A to 1C, the pipe expansion punch 50 includes a cylindrical section 51 having a diameter which is larger than the outer diameter of the hollow shell 1, and a tapered section 52 which is tapered from the cylindrical section 51 toward a tip end surface 50*a*. The tapered section 52 is decentered with a predetermined eccentric amount with respect to the cylindrical section 51. That is, a central axis CL2 of the cylindrical section 51, and a central axis CL3 of the tapered section 52 are parallel to and separated from each other.

In addition, the tapered section 52 has a first tapered surface 52*a* (first abutment surface) which abuts the thin section 1*a* of the hollow shell 1, and a second tapered surface 52*b* (second abutment surface) which abuts the thick section 1*b* of the hollow shell 1.

The first tapered surface 52*a* has a taper angle α (inclination angle). The second tapered surface 52*b* has a taper angle larger than the taper angle α, and the maximum taper angle is β. That is, the taper angle α is smaller than the taper angle β. Moreover, the taper angle indicates the inclination angle of the tapered surface with respect to the central axes CL2 and CL3 in a case where the pipe expansion punch 50 is viewed in a cross section including the central axes CL2 and CL3.

First, as shown in FIGS. 1A and 1B, when the flaring-processed metal pipe 20 is manufactured from the hollow shell 1, the pipe expansion punch 50 moves along the central axis CL1 of the hollow shell 1 and is inserted into the hollow shell 1 through the opening end 2 of the hollow shell 1. At this time, the pipe expansion punch 50 is inserted into the hollow shell 1 such that the first tapered surface 52*a* abuts the thin section 1*a* of the hollow shell 1 and the second tapered surface 52*b* abuts the thick section 1*b* of the hollow shell 1.

Figure 2:
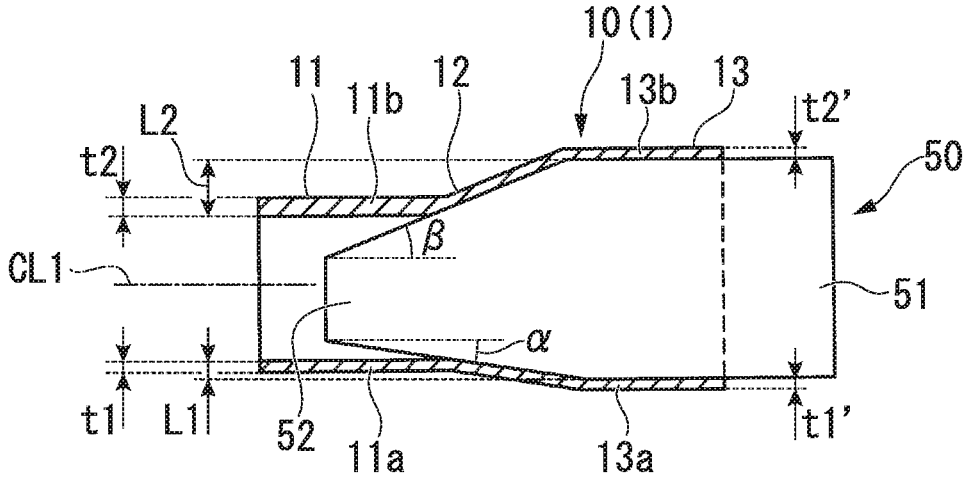
FIG. 2 is a sectional view showing a state in which the pipe expansion punch is press-fitted into the hollow shell.

In addition, as shown in FIG. 2, the pipe expansion punch 50 is pushed into a predetermined position in the hollow shell 1. At this time, since the pipe expansion punch 50 moves inside the hollow shell 1 while the tapered section 52 of the pipe expansion punch 50 abutting the hollow shell 1, the hollow shell 1 is spread in the radial direction thereof and is expanded along the shape of the pipe expansion punch 50. As a result, an intermediate formed product 10 shown in FIG. 2 can be obtained from the hollow shell 1.

For example, the pipe expansion punch 50 can be pushed into the hollow shell 1 using a pressurization mechanism such as a hydraulic cylinder, a gas cylinder, a spring, or a rubber.

In the above-described process, the hollow shell 1 is expanded in the radial direction while the first tapered surface 52*a* of the pipe expansion punch 50 abuts the thin section 1*a* of the hollow shell 1 and the second tapered surface 52*b* of the pipe expansion punch 50 abuts the thick section 1*b* of the hollow shell 1. At this time, since the taper angle of the second tapered surface 52*b* is larger than the taper angle of the first tapered surface 52*a*, the thick section 1*b* is preferentially subjected to tensile processing with respect to the thin section 1*a*. As a result, a thickness reduction rate of the thin section 1*a* of the hollow shell 1 can be smaller than the thickness reduction rate of the thick section 1*b* of the hollow shell 1. That is, when the hollow shell 1 is expanded, since it is possible to prevent concentration of deformation in the thin section 1*a*, it is possible to prevent occurrence of forming defects such as breakage in the thin section 1*a*.

As shown in FIG. 2, the intermediate formed product 10 includes a straight pipe section 11 which is a non-processed portion, a pipe expanded section 13, and a transition section 12 which is provided between the straight pipe section 11 and the pipe expanded section 13.

The pipe expanded section 13 of the intermediate formed product 10 has a portion 13*a* corresponding to the thin section 1*a* of the hollow shell 1 and a portion 13*b* corresponding to the thick section 1*b* of the hollow shell 1. In addition, the straight pipe section 11 of the intermediate formed product 10 has a portion 11*a* corresponding to the thin section 1*a* of the hollow shell 1 and a portion 11*b* corresponding to the thick section 1*b* of the hollow shell 1.

As described above, in the above-described process, the hollow shell 1 is expanded and formed such that the thickness reduction rate of the thin section 1*a* of the hollow shell 1 is smaller than the thickness reduction rate of the thick section 1*b* of the hollow shell 1. Therefore, in the intermediate formed product 10, a value (the thickness reduction rate of the thin section 1*a*) obtained by dividing a difference value (the thickness reduction amount of the thin section 1*a* of the hollow shell 1) between the thickness t1 of the portion 11*a* and a thickness t1' of the portion 13*a* by the thickness t1 is smaller than a value (the thickness reduction rate of the thick section 1*b*) obtained by dividing a difference value (the thickness reduction amount of the thick section 1*b* of the hollow shell 1) between the thickness t2 of the portion 11*b* and a thickness t2' of the portion 13*b* by the thickness t2.

Moreover, from the viewpoint of decreasing the amount of deformation of the thin section 1*a* and avoiding breakage of the thin section 1*a*, the diameter expansion amount L1 of the thin section 1*a* of the hollow shell 1 is less than 0.5 times a diameter expansion amount L2 of the thick section 1*b* of the hollow shell 1.

Here, the "diameter expansion amount" means the length of the hollow shell 1 expanded in the radial direction, and specifically, means the dimension (distance) between the inner surface of the pipe expanded section after processing and the inner surface of the hollow shell 1. That is, as shown in FIG. 2, "the diameter expansion amount L1 of the thin section 1*a* of the hollow shell 1" indicates the dimension between the inner surface of the portion 11*a* of the intermediate formed product 10 and the inner surface of the portion 13*a* of the intermediate formed product 10. Moreover, the "diameter expanded amount L2 of the thick section 1*b* of the hollow shell 1" indicates the dimension between the inner surface of the portion 11*b* of the intermediate formed product 10 and the inner surface of the portion 13*b* of the intermediate formed product 10.

Subsequently, the intermediate formed product 10 may be formed into the flaring-processed metal pipe 20 using a forming punch 60 and a stationary die 70 shown in FIG. 3. As shown in FIG. 3, the forming punch 60 has a cylindrical section 61, and a tapered section 62 which is tapered from the cylindrical section 61 toward the tip end surface 60*a*. Unlike the pipe expansion punch 50, in the forming punch 60, a central axis CL4 of the cylindrical section 61 coincides with the central axis of the tapered section 62. That is, the cylindrical section 61 and the tapered section 62 are coaxially formed.

The cylindrical section 61 has an outer surface shape which coincides with the shape of the inner surface of the pipe expanded section 23 of the flaring-processed metal pipe 20. The tapered section 62 has an outer surface shape which coincides with the inner surface of the transition section 23 of the flaring-processed metal pipe 20, and has a taper angle γ.

As shown in FIG. 3, the stationary die 70 includes a bottom wall section 71 which abuts the end surface of the straight pipe section 11 of the intermediate formed product 10, and a side wall section 72 which abuts the outer surface of the straight pipe section 11 of the intermediate formed product 10. Moreover, the inner surface shape of the side wall section 72 coincides with the outer surface shape of the flaring-processed metal pipe 20.

When the intermediate formed product 10 is formed into the flaring-processed metal pipe 20, first, the intermediate formed product 10 is set in the stationary die 70 along the bottom wall section 71 and the side wall section 72 of the stationary die 70. Thereafter, the forming punch 60 is pushed into the intermediate formed product 10. As described above, since the forming punch 60 has the shape conforming to the shape of the inner surface of the flaring-processed metal pipe 20 and the side wall section 72 of the stationary die 70 has the shape conforming to the outer surface shape of the flaring-processed metal pipe 20, it is possible to obtain the flaring-processed metal pipe 20 by pushing the forming punch 60 into the intermediate formed product 10.

According to the method of manufacturing the flaring-processed metal pipe 20 according to the above-described present embodiment, since the hollow shell 1 is expanded using the pipe expansion punch 50, the force for expanding the thin section 1*a* of the hollow shell 1 in the radial direction is weakened while the force for expanding the thick section 1*b* of the hollow shell 1 in the radial direction becomes stronger. That is, since the hollow shell 1 is expanded such that the thickness reduction rate of the thin section 1*a* of the hollow shell 1 is smaller than the thickness reduction rate of the thick section 1*b* of the hollow shell 1, it is possible to prevent concentration of deformation in the thin section 1*a*, and it is possible to prevent breakage or the like of the hollow material 1. As a result, it is possible to manufacture a flaring-processed metal pipe having a larger pipe expansion rate than that of the related art.

Moreover, according to the method of manufacturing the flaring-processed metal pipe 20 according to the present embodiment, since the hollow shell 1 is expanded such that the thickness reduction rate of the thin section 1*a* of the hollow shell 1 is smaller than the thickness reduction rate of the thick section 1*b* of the hollow shell 1, it is possible to manufacture a flaring-processed metal pipe including a pipe expanded section having a uniform thickness from the hollow shell 1 having a non-uniform thickness distribution.

Here, the above-described "pipe expansion rate" means a rate at which the outer diameter of the pipe expanded section after the pipe expansion forming is performed is increased with respect to the outer diameter of the hollow shell 1. That is, in a case where the pipe expansion rate is defined as P (%), the outer diameter of the pipe expanded section after pipe expansion forming performed is defined as d1 (mm), and the outer diameter of the hollow shell 1 is defined as d2 (mm), the pipe expansion rate P is represented by the following Expression (1).

$$P=((d1-d2)/d2)\times 100 \qquad \text{Expression (1)}$$

In addition, when the hollow shell 1 is formed into the intermediate formed product 10, if the pipe expansion rate of the intermediate formed product 10 is decreased, effects for preventing the breakage of the thin section 1*a* of the hollow shell 1 decrease. Therefore, preferably, the hollow shell 1 is formed into the intermediate formed product 10 so that the pipe expansion rate of the intermediate formed product 10 becomes 50% or more with respect to the pipe expansion rate of the flaring-processed metal pipe 20.

In addition, compared to a case where the material of the hollow shell 1 is an aluminum alloy, in a case where the material of the hollow shell 1 is stainless steel, forming defects easily occur when the pipe expansion forming is performed. Accordingly, compared to the case where the material of the hollow shell 1 is the aluminum alloy, in the case where the material of the hollow shell 1 is stainless steel, the effects for preventing breakage in the thin section 1*a* increase.

[Modification Example of First Embodiment]

In the present embodiment, the case where the hollow shell 1 has the thin section 1*a* and the thick section 1*b* (that is, the case where the thickness distribution in the circumferential direction is non-uniform) is described. However, for example, the flaring-processed metal pipe may be manufactured from a hollow shell having a non-uniform hardness distribution in the circumferential direction. In this case, the hardness distribution is ascertained by a tensile test, hardness measurement or the like, the first tapered surface 52*a* of the pipe expansion punch 50 may abut a low hardness section (low deformation resistance section) having a relatively low hardness, and the second tapered surface 52*b* of the pipe expansion punch 50 may abut a high hardness section (high deformation resistance section) having a relatively high hardness. In this case, for example, a portion having a hardness which is less than 95% with respect to the average value of the hardness of the hollow shell can be specified as the low hardness section.

In addition, for example, in a case where the hollow shell has both a non-uniform thickness distribution and a non-uniform hardness distribution, a portion in which the product value between the thickness and the hardness is less than 95% of the average value is specified as the low deformation resistance section, and the first tapered surface 52*a* of the pipe expansion punch 50 may abut the low deformation resistance section.

Figure 4A:
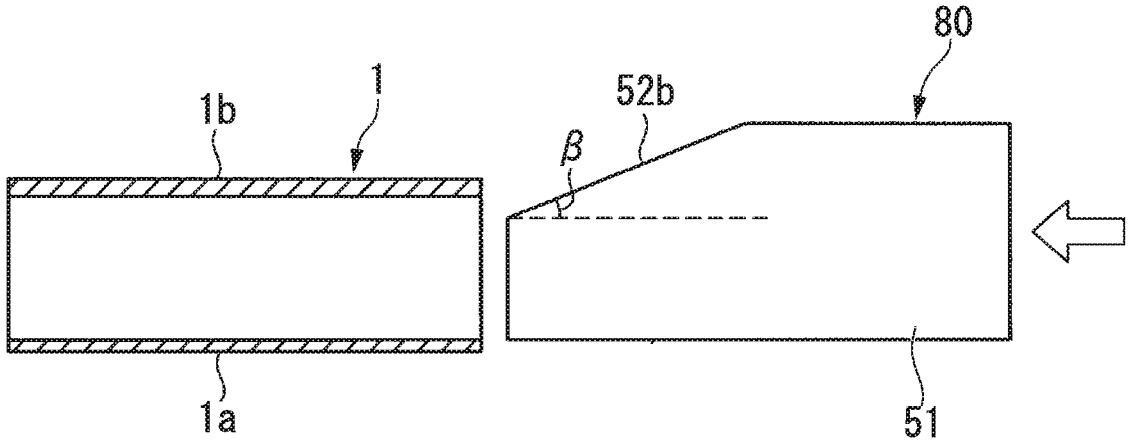
FIG. 4A is a sectional view showing a first modification example of the method of manufacturing the flaring-processed metal pipe.
Figure 4B:
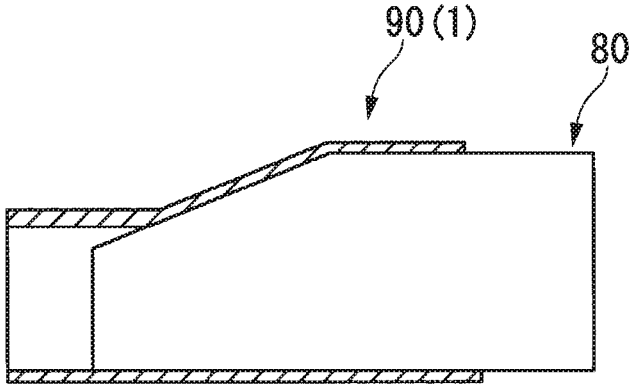
FIG. 4B is a sectional view showing the continuation of the manufacturing method according to the modification example.

In addition, in the present embodiment, the case where the first tapered surface 52*a* of the pipe expansion punch 50 has the taper angle α (refer to FIG. 1B or the like) is described. However, as shown in FIGS. 4A and 4B, a pipe expansion punch 80 having the taper angle α of 0° may be press-fitted into the hollow shell 1 to form the hollow shell 1 into the intermediate formed product 90. In this case, it is possible to further prevent deformation of the thin section 1*a* (a decrease in the thickness of the thin section 1*a*), and it is possible to reliably prevent the occurrence of defects in the thin section 1*a*.

Figure 5A:
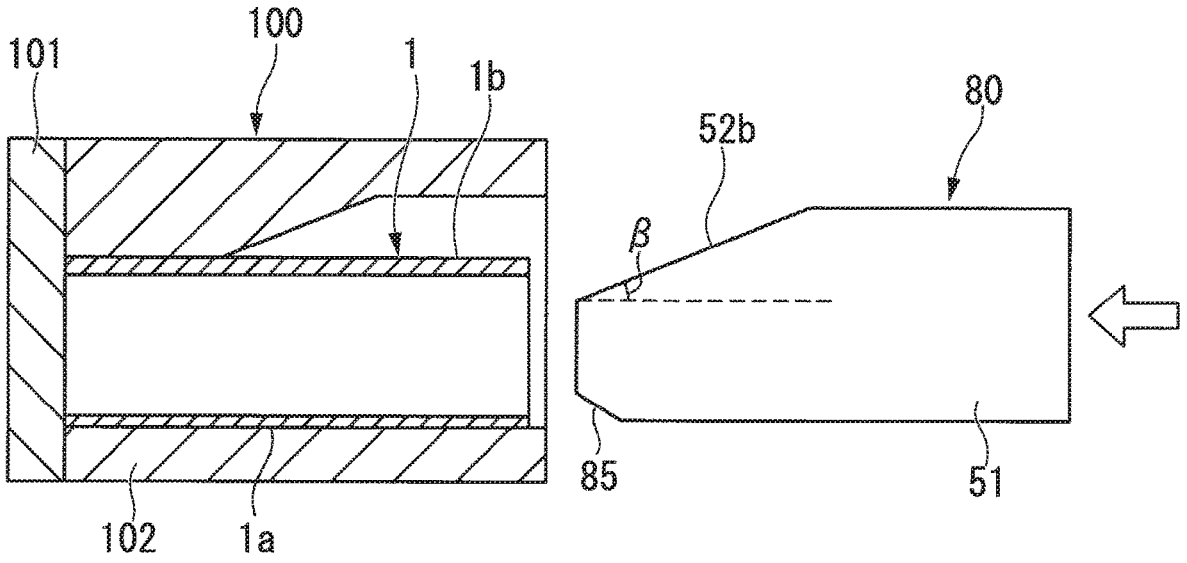
FIG. 5A is a sectional view showing a second modification of the method of manufacturing the flaring-processed metal pipe.
Figure 5B:
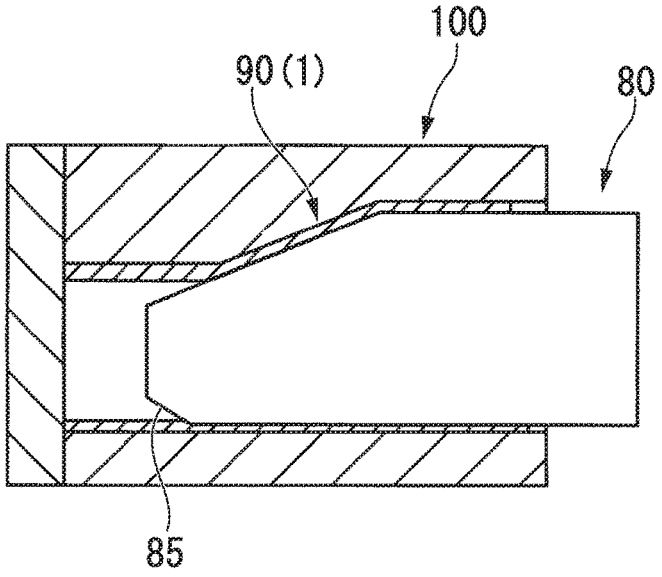
FIG. 5B is a sectional view showing the continuation of the manufacturing method according to the modification example.

In addition, as shown in FIGS. 5A and 5B, the hollow shell 1 may be expanded and formed using the pipe expansion punch 80 having a cutout part 85 at the tip and a stationary die 100 having a bottom wall section 101 and a side wall section 102. In this case, since the cutout part 85 is provided, the pipe expansion punch 80 can be smoothly pushed into the hollow shell 1. Moreover, preferably, a gap between the first tapered surface 52*a* and the side wall section 102 of the stationary die 100 is set to be 0.9 to 0.99 times the thickness of the hollow shell 1. In this case, occurrence of deformation at the thin section 1*a* can be more reliably prevented.

Figure 6A:
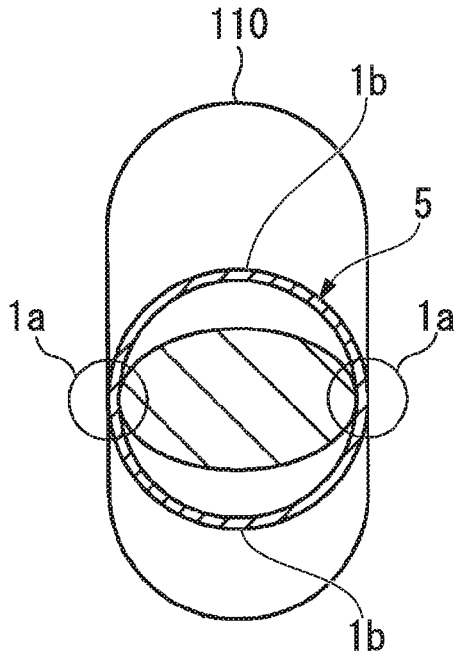
FIG. 6A is a view showing a third modification example of the method of manufacturing the flaring-processed metal pipe, and is a front view showing a pipe expansion punch and a hollow shell used in the modification example.
Figure 6B:
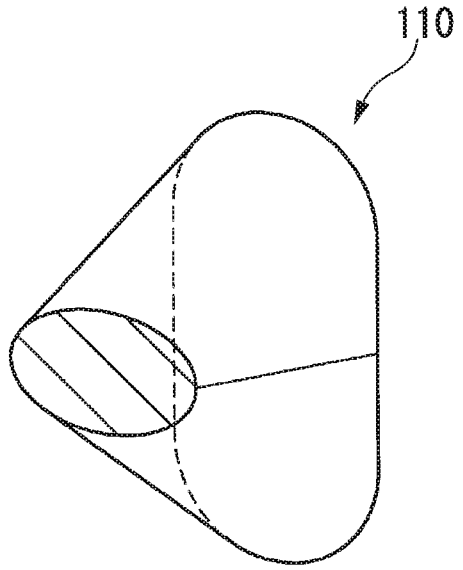
FIG. 6B is a schematic perspective view showing the pipe expansion punch.

In addition, in the present embodiment, the case where the hollow shell 1 having the thin section 1*a* provided at one location is expanded and formed is shown. However, as shown in FIG. 6A, a hollow shell 5 having the thin sections 1*a* provided at two locations may be expanded and formed. In this case, similarly to the present embodiment, it is possible to prevent the occurrence of defects in the thin section 1*a* using a pipe expansion punch 110 shown in FIGS. 6A and 6B.

Figure 7A:
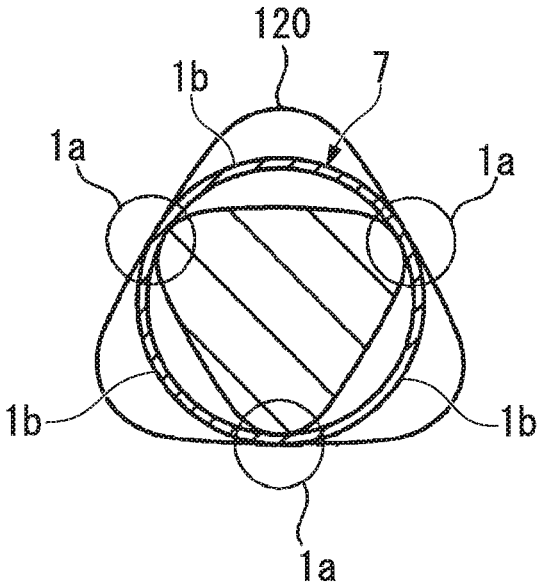
FIG. 7A is a view showing a fourth modification example of the method for manufacturing the flaring-processed metal pipe, and is a front view showing a pipe expansion punch and a hollow shell used in the modification example.
Figure 7B:
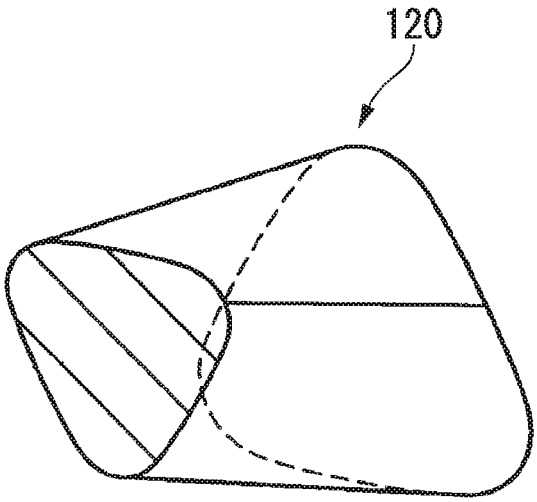
FIG. 7B is a schematic perspective view showing the pipe expansion punch.

Moreover, as shown in FIG. 7A, a hollow shell 7 having the thin sections 1*a* provided at three locations may be expanded and formed. In this case, similarly to the present embodiment, it is possible to prevent the occurrence of defects in the thin section 1*a* using the pipe expansion punch 120 shown in FIGS. 7A and 7B.

Second Embodiment

Next, a second embodiment of the present invention will be described.

In the above-described first embodiment, the case where the flaring-processed metal pipe 20 is manufactured from the hollow shell 1 using the pipe expansion punch 50 and the forming punch 60 is described. Meanwhile, in the present embodiment, a flaring-processed metal pipe 220 shown in FIG. 8C is manufactured from the hollow shell 1 using a pipe expansion punch 250 shown in FIG. 8A.

Figure 8A:
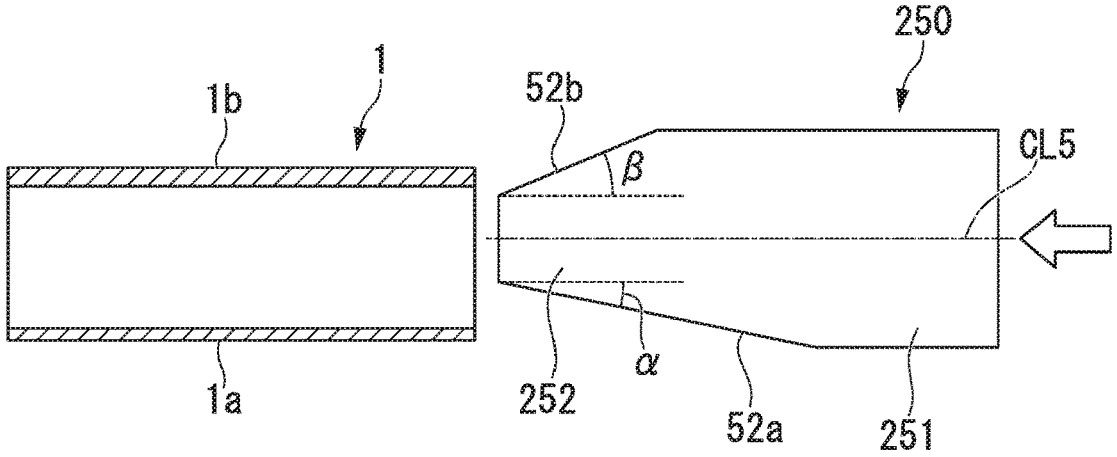
FIG. 8A is a sectional view showing a hollow shell and a pipe expansion punch used in a method of manufacturing a flaring-processed metal pipe according to a second embodiment of the present invention.

As shown in FIG. 8A, the pipe expansion punch 250 has a cylindrical section 251 and a tapered section 252. The pipe expansion punch 250 is different from the pipe expansion punch 50 of the first embodiment in that the cylindrical section 251 and the tapered section 252 are formed along the same central axis CL5.

Figure 8B:
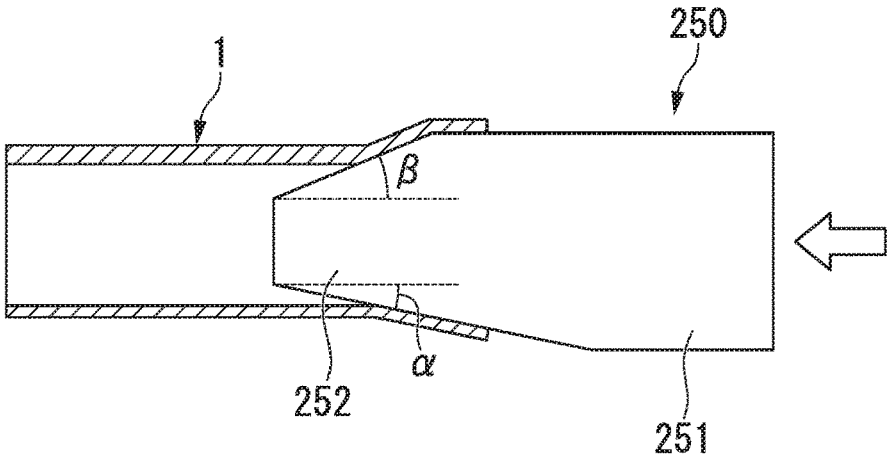
FIG. 8B is a view for explaining the method of manufacturing the flaring-processed metal pipe, and is a sectional view showing a state in which the pipe expansion punch is press-fitted into the hollow shell.

Similarly to the case of the first embodiment, in the method of manufacturing the flaring-processed metal pipe 220 according to the present embodiment, the pipe expansion punch 250 is press-fitted into the hollow shell 1. FIG. 8B is a view showing a state in which the pipe expansion punch 250 is press-fitted to a predetermined position in the hollow shell 1. In the state shown in FIG. 8B, the thick section 1*b* of the hollow shell 1 abuts the cylindrical section 251 of the pipe expansion punch 250, and the thin section 1*a* of the hollow shell 1 abuts the tapered section 252 of the pipe expansion punch 250.

Figure 8C:
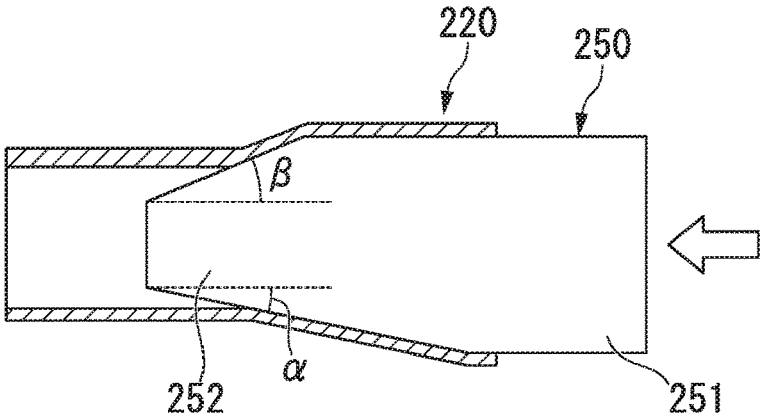
FIG. 8C is a sectional view showing the continuation of the method of manufacturing the flaring-processed metal pipe.

FIG. 8C is a view showing a state in which the pipe expansion punch 250 is further press-fitted into the hollow shell 1 from the state shown in FIG. 8B. As shown in FIG. 8C, the flaring-processed metal pipe 220 can be obtained by press-fitting the pipe expansion punch 250 into the hollow shell 1 until the thin section 1*a* abuts the cylindrical section 251 of the pipe expansion punch 250.

In the present embodiment, since the taper angle β of the second tapered surface 52*b* which abuts the thick section 1*b* is larger than the angle α of the first tapered surface 52*a* which abuts the thin section 1*a*, the thick section 1*b* is preferentially subjected to tensile processing. That is, similarly to the case of the first embodiment, it is possible to prevent occurrence of forming defects in the thin section 1*a* by allowing the thickness reduction rate of the thin section 1*a* to be smaller than the thickness reduction rate of the thick section 1*b*.

EXAMPLE

Next, examples conducted for confirming effects of the present invention will be described.

According to the manufacturing method of the first embodiment, three kinds of flaring-processed metal pipes having different diameters of the pipe expanded sections were manufactured. In addition, for comparison, a flaring-processed metal pipe was manufactured according to a related art in which a flaring-processed metal pipe was manufactured using only a forming punch. In the flaring-processed metal pipes, the forming defects were evaluated by visually checking the presence or absence of breakage.

Example 1

(1) Hollow Shell

As the hollow shell 1, a seamless steel pipe having 73 mm in the outer diameter and 6 mm in the average thickness was used. The thickness of the thin section 1*a* of the hollow shell 1 was 5.6 mm, and the thickness of the thick section 1*b* of the hollow shell 1 was 6.4 mm.

(2) Punch

The pipe expansion punch 50 and the forming punch 60 were used.

In the pipe expansion punch 50, the taper angle α was 4.5°, the taper angle β was 24.6°, and the diameter of the cylindrical section 51 was 81.2 mm. In the forming punch 60, the taper angle γ was 15°, and the diameter of the cylindrical section 61 was 81.2 mm.

(3) Stationary Die

In the stationary die 70, the inner diameter D (refer to FIG. 3) of the side wall sections 72 was 93.2 mm.

(4) Manufacturing Process

The intermediate formed product 10 was manufactured by pushing the pipe expansion punch 50 into the hollow shell 1 to expand the hollow shell 1. At this time, the intermediate formed product 10 was manufactured such that L1 shown in FIG. 2 was 0.17 times L2.

Thereafter, the intermediate formed product 10 was disposed on the stationary die 70 and the forming punch 60 was pushed into the intermediate formed product 10 to manufacture the flaring-processed metal pipe 20.

(5) Evaluation of Forming Defects

Forming defects such as cracks did not occur in the intermediate formed product 10 and the flaring-processed metal pipe 20. In addition, the pipe expansion rate of the flaring-processed metal pipe 20 was 30%.

Example 2

(1) Hollow Shell

Figure 9:
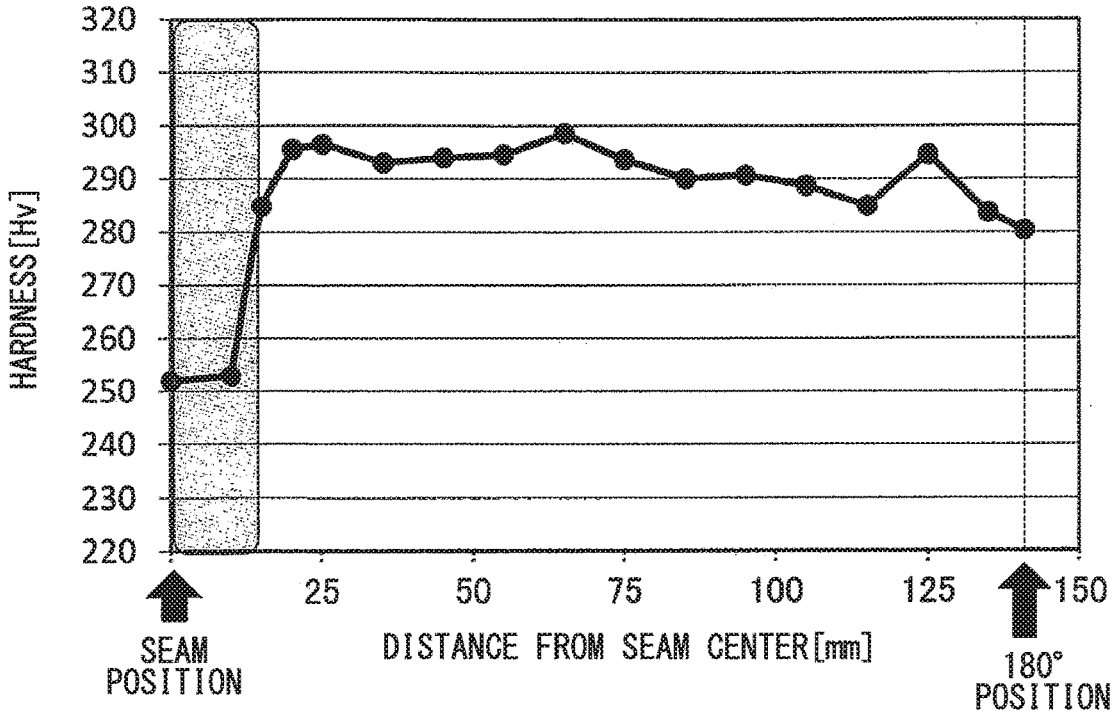
FIG. 9 is a diagram showing a hardness distribution of a hollow shell used in Example 2.
Figure 10A:
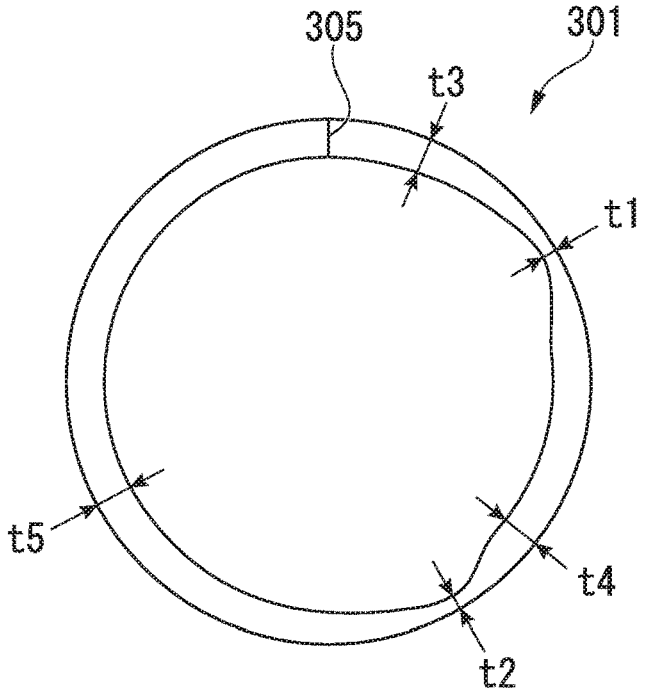
FIG. 10A is a cross-sectional view showing an electric resistance welded steel pipe and is a view showing an example of a thickness distribution of the electric resistance welded steel pipe.
Figure 10B:
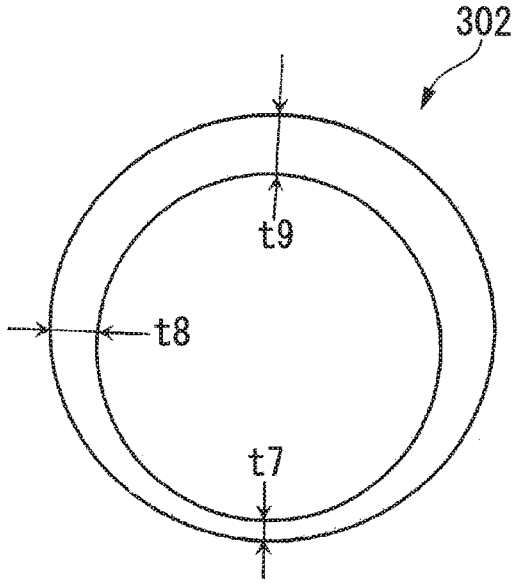
FIG. 10B is a cross-sectional view showing a seamless steel pipe, and a view showing an example of a thickness distribution of the seamless steel pipe.
Figure 11:
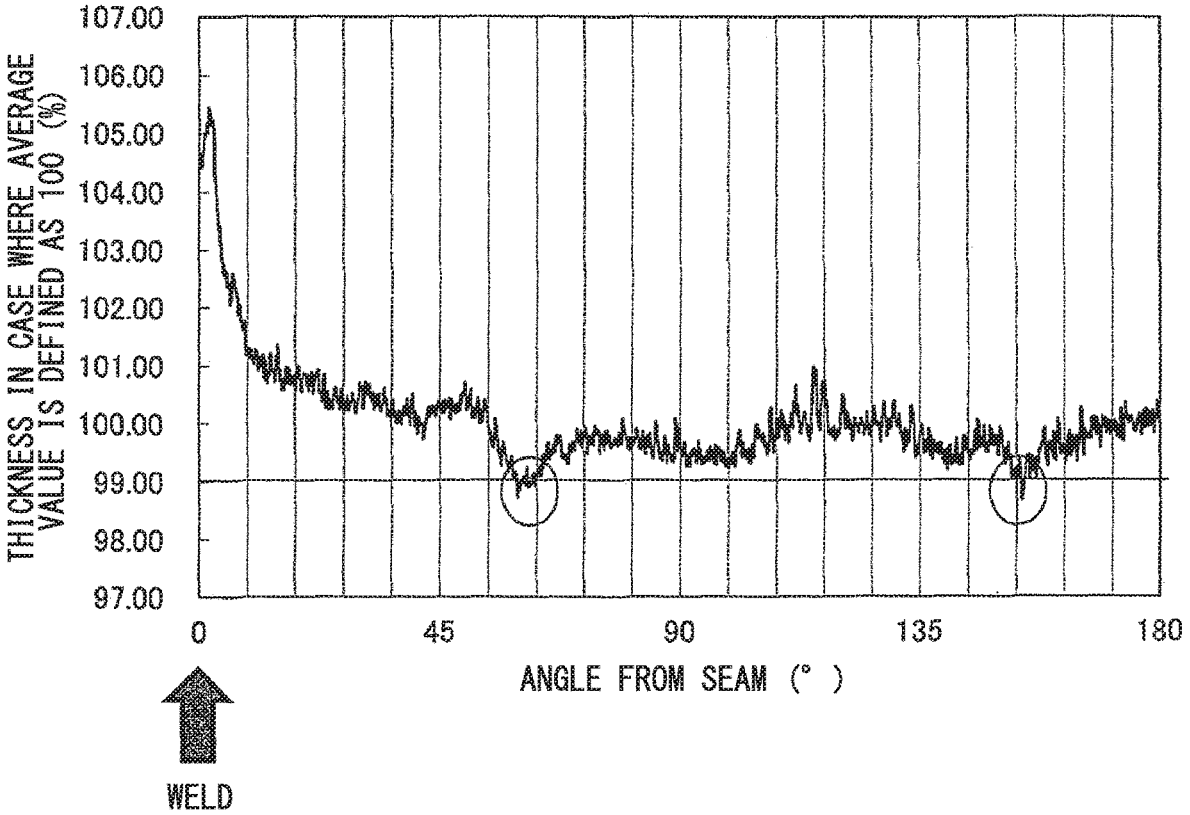
FIG. 11 is a graph showing a thickness distribution of the electric resistance welded steel pipe in a circumferential direction.
Figure 12:
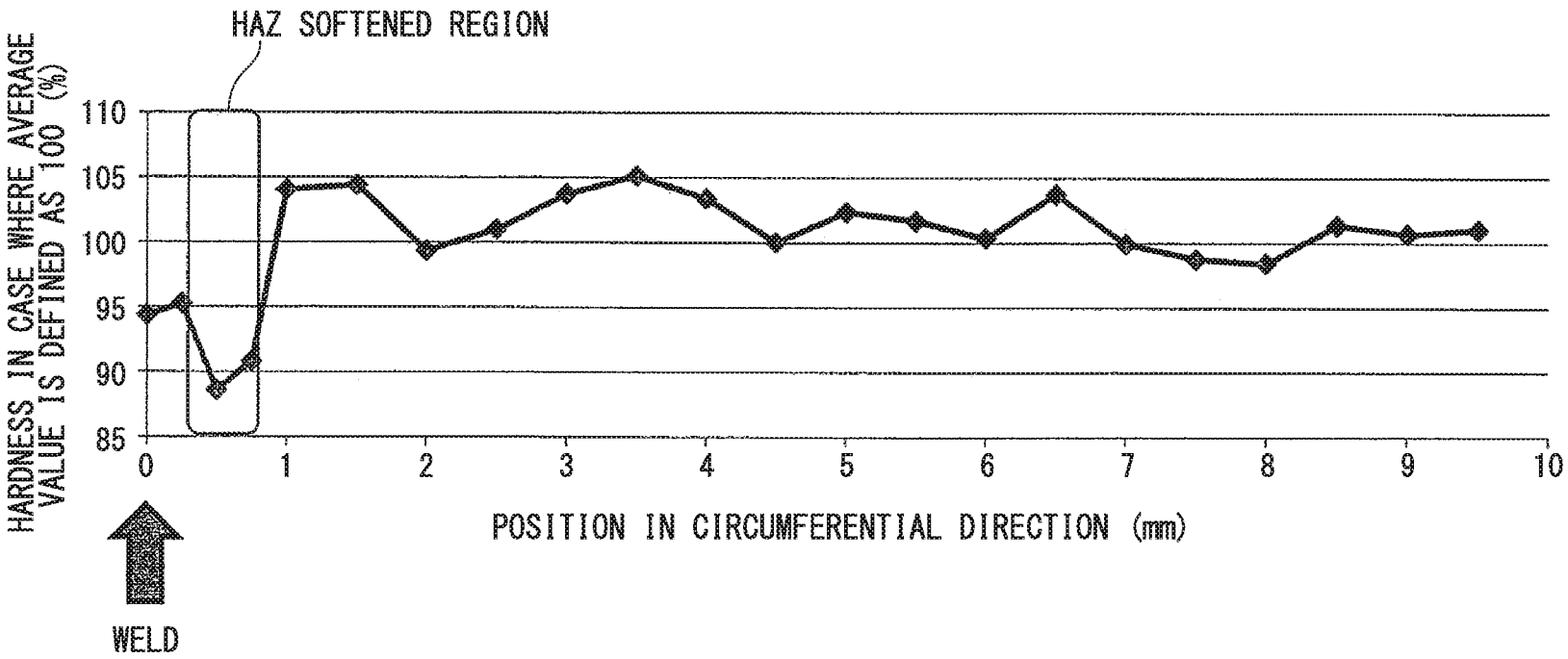
FIG. 12 is a graph showing the hardness distribution of the electric resistance welded steel pipe in the circumferential direction.

As the hollow shell 1, an electric resistance welded steel pipe having 90.0 mm in the outer diameter and 2.8 mm in the average thickness was used. In the electric resistance welded steel pipe, the tensile strength TS was 80 kgf/mm$^2$ (785 MPa), and the hardness distribution in the circumferential direction was the distribution shown in FIG. 9.

(2) Punch

The pipe expansion punch 50 and the forming punch 60 were used.

In pipe expansion punch 50, the taper angle $\alpha$ was 4.5°, the taper angle $\beta$ was 24.6°, and the diameter of the cylindrical section 51 was 112.4 mm.

In the forming punch 60, the taper angle $\gamma$ was 15°, and the diameter of the cylindrical section 61 was 112.4 mm.

(3) Stationary Die

In the stationary die 70, the inner diameter D (refer to FIG. 3) of the side wall sections 72 was 117 mm.

(4) Manufacturing Process

The intermediate formed product 10 was manufactured by pushing the pipe expansion punch 50 into the hollow shell 1 to expand the hollow shell 1. At this time, the intermediate formed product 10 was manufactured such that L1 shown in FIG. 2 was 0.17 times L2.

Thereafter, the intermediate formed product 10 was disposed on the stationary die 70 and the forming punch 60 was pushed into the intermediate formed product 10 to manufacture the flaring-processed metal pipe 20.

(5) Evaluation of Forming Defects

Forming defects such as cracks did not occur in the intermediate formed product 10 and the flaring-processed metal pipe 20. In addition, the pipe expansion rate of the flaring-processed metal pipe 20 was 30%.

Example 3

(1) Hollow Shell

As a hollow shell 1, the same electric resistance welded steel pipe as that of Example 2 was used.

(2) Punch

The pipe expansion punch 50 and the forming punch 60 were used.

In the pipe expansion punch 50, the taper angle $\alpha$ was 7.5°, the taper angle $\beta$ was 21.9°, and the diameter of the cylindrical section 51 was 129.4 mm.

In the forming punch 60, the taper angle $\gamma$ was 15°, and the diameter of the cylindrical section 61 was 129.4 mm.

(3) Stationary Die

In the stationary die 70, the inner diameter D (refer to FIG. 3) of the side wall sections 72 was 135 mm.

(4) Manufacturing Process

Similarly to Examples 1 and 2, the intermediate formed product 10 was manufactured. In addition, in the present example, the intermediate formed product 10 was manufactured such that L1 shown in FIG. 2 was 0.33 times L2.

(5) Evaluation of Forming Defects

Forming defects such as cracks did not occur in the intermediate formed product 10 and the flaring-processed metal pipe 20. In addition, the pipe expansion rate of the flaring-processed metal pipe 20 was 50%.

Reference Example 1

(1) Hollow Shell

The same electric resistance welded steel pipe as that of Example 2 was used.

(2) Punch

Unlike Examples 1 to 3, the pipe expansion punch 50 was not used, and only the forming punch 60 was used (3) Stationary Die The same stationary die 70 as that of Example 2 was used.

(4) Manufacturing Process

The hollow shell 1 was disposed in the stationary die 70, the forming punch 60 was pushed into the hollow shell 1 to expand the hollow shell, and the flaring-processed metal pipe was manufactured.

(5) Evaluation of Forming Defects

The pipe expansion rate of the flaring-processed metal pipe was 30%, and the forming defects such as cracks did not occur in the flaring-processed metal pipe. In addition, in the present reference example, since the pipe expansion rate was as low as 30%, it was considered that forming defects did not occur even when the pipe expansion punch 50 was not used.

Comparative Example 1

(1) Hollow Shell

The same electric resistance welded steel pipe as that of Example 2 was used.

(2) Punch

Unlike the above-described Examples 1 to 3, the pipe expansion punch 50 was not used, and only the forming punch 60 was used (that is, the same as Reference Example 1).

(3) Die

The same stationary die 70 as that of Example 2 was used.

(4) Manufacturing Process

The hollow shell 1 was disposed in the stationary die 70, the forming punch 60 was pushed into the hollow shell 1 to expand the hollow shell, and the flaring-processed metal pipe was manufactured.

(5) Evaluation of Forming Defects

The pipe expansion rate of the flaring-processed metal pipe was 50%, and cracks occurred in the flaring-processed metal pipe.

According to Examples 1 to 3, even when the low deformation resistance section having a small deformation resistance in the circumferential direction and a high deformation resistance section having a deformation resistance which is greater than that of the low deformation resistance section existed in the hollow shell 1, it was possible to prevent forming defects such as cracks without applying a burden onto the low deformation resistance section.

Particularly, according to the comparison between Example 3 and Comparative Example 1, with respect to a product having a high pipe expansion rate in which cracks were generated in the related art, it was configured that the product could be manufactured without occurrence of cracks.

Hereinbefore, the embodiments of the present invention are described, the embodiments are suggested by way of example, and the scope of the present invention is not limited to the embodiments. The embodiments can be embodied in other various forms, and various omissions, replacements, and modifications can be performed within the scope which does not depart from the gist of the present invention. The embodiments and the modifications are included in the scope and gist of the invention, and similarly, are also included in the inventions described in claims and the equivalent scopes.

For example, in the first embodiment, the case where the hollow shell 1 is formed into the intermediate formed product 10 using a pipe expansion punch 50 is described. However, the hollow shell 1 may be formed stepwise (at a plurality of times) using a plurality of pipe expansion punches having different outer diameters.

In addition, for example, in the first embodiment, the case where the intermediate formed product 10 is formed into the flaring-processed metal pipe 20 using the forming punch 60 is described. However, the intermediate formed product 10 obtained by the pipe expansion punch 50 without using the forming punch 60 may be the flaring-processed metal pipe. In this case, it is possible to obtain an eccentric flaring-processed metal pipe.

INDUSTRIAL APPLICABILITY

According to the present invention, a method of manufacturing a flaring-processed metal pipe can be provided, in which it is possible to prevent occurrence of forming defects such as breakage when a flaring-processed metal pipe is manufactured from a hollow shell including a portion having a relatively small deformation resistance.

BRIEF DESCRIPTION OF THE REFERENCE NUMERALS

1: hollow shell
1*a*: thin section (low deformation resistance section)
1*b*: thick section (high deformation resistance section)
10: intermediate formed product
20: flaring-processed metal pipe
50: pipe expansion punch
60: forming punch
70: stationary die

The invention claimed is:

1. A method of manufacturing a flaring-processed metal pipe having a pipe expanded section from a hollow shell including a plurality of portions having different deformation resistances when viewed in a circumferential direction, the method comprising:

among the plurality of portions spaced in the circumferential direction, specifying one of the plurality of portions as a low deformation resistance section having a first deformation resistance, and another of the plurality of portions as a high deformation resistance section having a second deformation resistance, the second deformation resistance being greater than the first deformation resistance; and press-fitting a pipe expansion punch into the hollow shell and expanding the hollow shell, so that a thickness reduction rate of the low deformation resistance section is smaller than a thickness reduction rate of the high deformation resistance section.

2. The method of manufacturing a flaring-processed metal pipe according to claim 1, wherein the pipe expansion punch includes a first abutment surface which abuts the low deformation resistance section of the hollow shell, and a second abutment surface which abuts the high deformation resistance section of the hollow shell, and an inclination angle of the first abutment surface with respect to the central axis of the pipe expansion punch is smaller than an inclination angle of the second abutment surface with respect to the central axis, and wherein in the press-fitting and the expanding, the pipe expansion punch is press-fitted into the hollow shell while the first abutment surface of the pipe expansion punch abuts the low deformation resistance section of the hollow shell and the second abutment surface of the pipe expansion punch abuts the high deformation resistance section of the hollow shell.

3. The method of manufacturing a flaring-processed metal pipe according to claim 2, wherein the inclination angle of the first abutment surface of the pipe expansion punch is 0°.

4. The method of manufacturing a flaring-processed metal pipe according to claim 3, wherein the press-fitting and the expanding include:

press-fitting the pipe expansion punch into the hollow shell to obtain an intermediate formed product from the hollow shell; and press-fitting a forming punch having a shape which coincides with an inner surface of the pipe expanded section of the flaring-processed metal pipe into the intermediate formed product.

5. The method of manufacturing a flaring-processed metal pipe according to claim 4, wherein the hollow shell is an electric resistance welded steel pipe or a seamless steel pipe.

6. The method of manufacturing a flaring-processed metal pipe according to claim 4, wherein in the press-fitting of the pipe expansion punch, the pipe expansion punch is press-fitted into the hollow shell such that a diameter expansion amount of the low deformation resistance section of the hollow shell is less than 0.5 times a diameter expansion amount of the high deformation resistance section of the hollow shell.

7. The method of manufacturing a flaring-processed metal pipe according to claim 6, wherein the hollow shell is an electric resistance welded steel pipe or a seamless steel pipe.

8. The method of manufacturing a flaring-processed metal pipe according to claim 3, wherein the hollow shell is an electric resistance welded steel pipe or a seamless steel pipe.

9. The method of manufacturing a flaring-processed metal pipe according to claim 2, wherein the press-fitting and the expanding include:

press-fitting the pipe expansion punch into the hollow shell to obtain an intermediate formed product from the hollow shell; and press-fitting a forming punch having a shape which coincides with an inner surface of the pipe expanded section of the flaring-processed metal pipe into the intermediate formed product.

10. The method of manufacturing a flaring-processed metal pipe according to claim 9, wherein the hollow shell is an electric resistance welded steel pipe or a seamless steel pipe.

11. The method of manufacturing a flaring-processed metal pipe according to claim 9, wherein in the press-fitting of the pipe expansion punch, the pipe expansion punch is press-fitted into the hollow shell such that a diameter expansion amount of the low deformation resistance section of the hollow shell is less than 0.5 times a diameter expansion amount of the high deformation resistance section of the hollow shell.

12. The method of manufacturing a flaring-processed metal pipe according to claim 11, wherein the hollow shell is an electric resistance welded steel pipe or a seamless steel pipe.

13. The method of manufacturing a flaring-processed metal pipe according to claim 2, wherein the hollow shell is an electric resistance welded steel pipe or a seamless steel pipe.

14. The method of manufacturing a flaring-processed metal pipe according to claim 2, wherein the first abutment surface and the second abutment surface are sections of a conical surface.

15. The method of manufacturing a flaring-processed metal pipe according to claim 1, wherein the hollow shell is an electric resistance welded steel pipe or a seamless steel pipe.

16. The method of manufacturing a flaring-processed metal pipe according to claim 1, wherein the low deformation resistance section has a smaller thickness than the high deformation resistance section.

* * * * *